US005125210A

United States Patent [19]

Lang et al.

[11] Patent Number: 5,125,210

[45] Date of Patent: Jun. 30, 1992

[54] PROCEDURE AND DEVICE FOR THE WRAPPING OS COMPRESSED BALES

[75] Inventors: Jurgen Lang, Gessertshauesen; Herwig Hirschek, Bobigen, both of Fed. Rep. of Germany

[73] Assignee: Autefa Mashinen Fabrik GmbH, Friedberd, Fed. Rep. of Germany

[21] Appl. No.: 302,595

[22] PCT Filed: Jun. 10, 1988

[86] PCT No.: PCT/EP88/00517

§ 371 Date: Oct. 9, 1990

§ 102(e) Date: Oct. 9, 1990

[87] PCT Pub. No.: WO88/09748

PCT Pub. Date: Dec. 15, 1988

[30] Foreign Application Priority Data

Jun. 10, 1987 [DE] Fed. Rep. of Germany ..... 3719274

[51] Int. Cl.[5] ..... B65B 63/02; B65B 27/12

[52] U.S. Cl. ..... 53/399; 53/126; 53/436; 53/438; 53/449; 53/528; 53/529; 53/586; 53/DIG. 2

[58] Field of Search ..... 53/399, 449, 441, 466, 53/229, 528, 176, 586, DIG. 2, 529

[56] References Cited

U.S. PATENT DOCUMENTS

| | | | |
|---|---|---|---|
| 3,593,490 | 7/1921 | Pinatel | 53/229 X |
| 3,640,048 | 2/1972 | Zelnick | 53/176 X |
| 3,672,116 | 6/1972 | Ingmarson | 53/229 X |
| 3,962,846 | 6/1976 | Neitzel | 53/528 |
| 4,044,529 | 8/1977 | Zelnick | 53/229 X |
| 4,318,264 | 3/1982 | Rewitzer | 53/528 X |
| 4,408,438 | 10/1983 | Rewitzer | 53/528 X |
| 4,450,668 | 5/1984 | Grossi | 53/176 |
| 4,738,078 | 4/1988 | Benz | 53/528 X |

FOREIGN PATENT DOCUMENTS 738958 6/1980 U.S.S.R. ..... 53/DIG. 2

*Primary Examiner*—John Sipos

*Attorney, Agent, or Firm*—McGlew & Tuttle

[57] ABSTRACT

A device for covering bales of unpacted fiber materials includes a winding device, which has spaced apart substantially parallel first and second rolls of bale covering material, on which a single covering material is wound such that the material extends between the two rolls of material. A bale of the fibrous material is formed on a support which, in one embodiment, comprises a carriage so that there is a relative movement between the bale support and the winding device, so as to cause the support with the bale to move through the plane of the covering material, thus, cause the material to wrap around the adjacent end and the sides, and up to the front end which is opposite the adjacent end. Covering material ends, which are arrived at the front of the bale are directed to a clamping device so that they are closed in the front of the bale. A closing is also advantageously effected by welding the ends together at the bale, thus, close the covering over the bale and to also sever the ends of the covering material away from the bale and to weld these ends together, so that the covering material may be used again. The invention also includes means for feeding both a top lid covering, and a bottom covering so that these coverings are directed against the bale as it is being compacted thereafter enclosed with the side covering material. A device for cutting the covering material as well as for welding it, and for welding together the severed ends of the covering material functions to effect one or more of these operations in accordance with the plant arrangement.

29 Claims, 16 Drawing Sheets

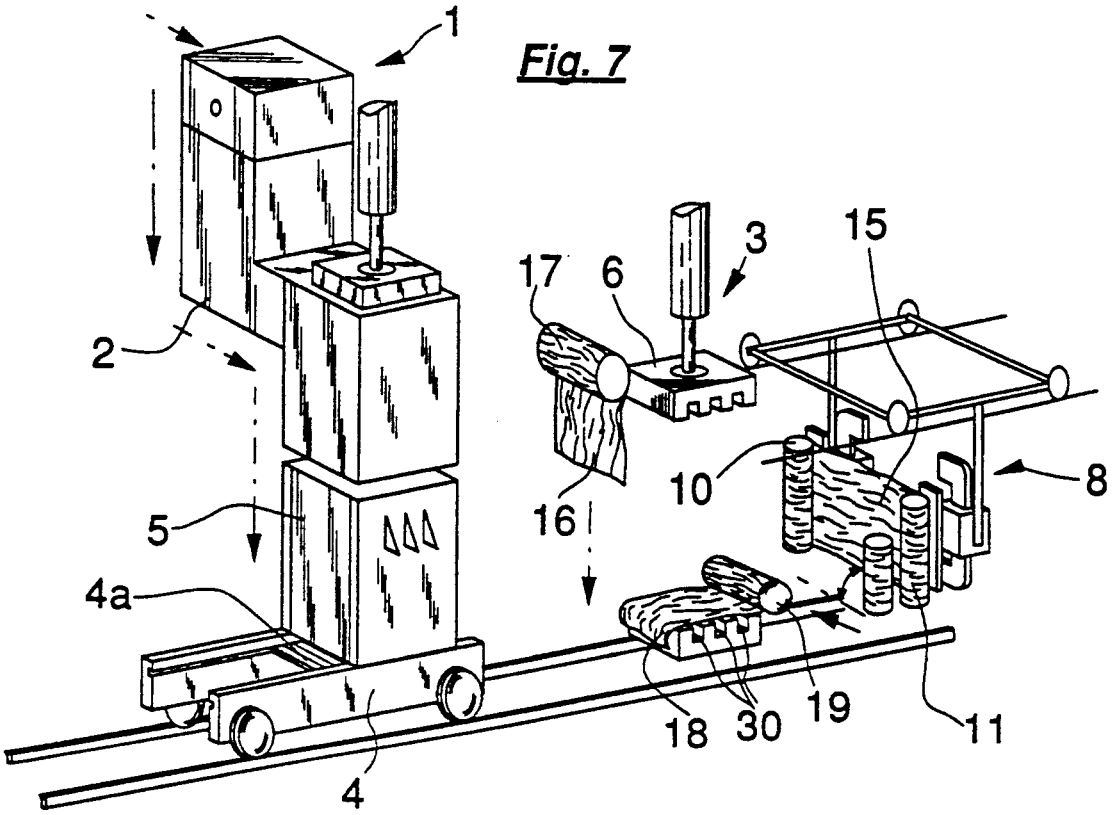
Fig. 7
Fig. 8
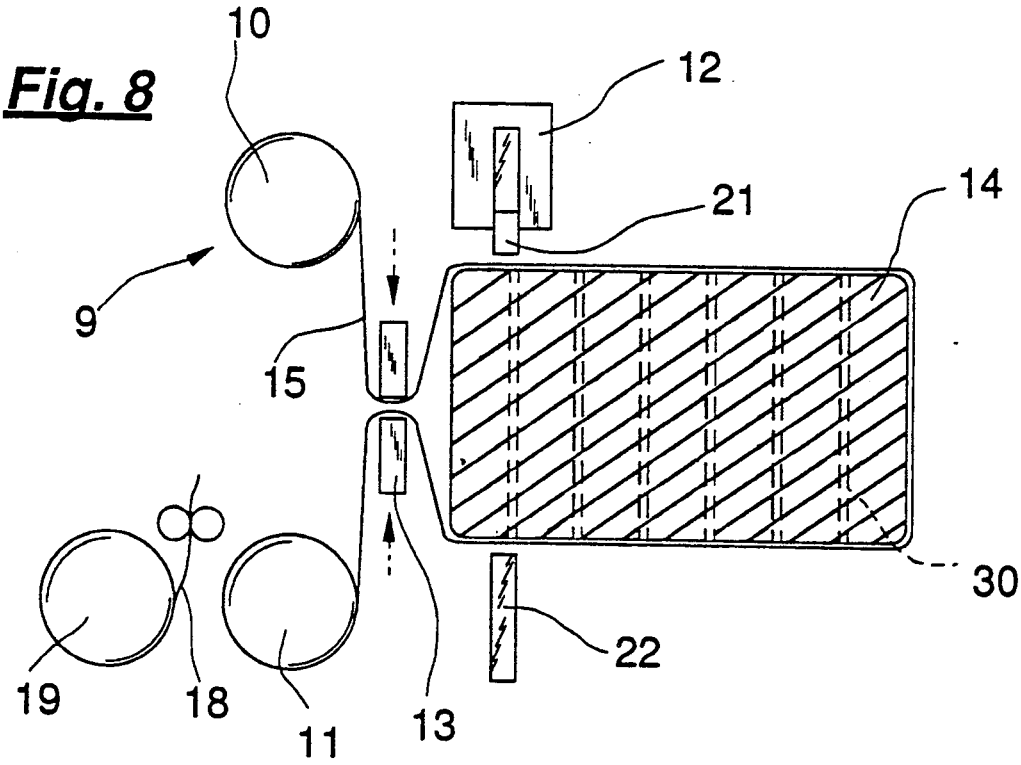

47
48
56
28
VI
I
14
47
8
12
10
9
13
27
55
50
51
55
VII
49
48

PROCEDURE AND DEVICE FOR THE WRAPPING OS COMPRESSED BALES

FIELD OF THE INVENTION

The invention relates in general to packaging devices and in particular to a new and useful process and device for the wrapping of compressed bales, in particular of fibre bales.

BACKGROUND OF THE INVENTION

A similar device is known from German Patent DE-OS 29 11 958. Herein the readily compressed bale is wrapped with a jacket in the shape of a polyethylene foil. This is effected by means of a complicated pivoting lever, which grips sideways around the bale and carries a coil with the jacket foil. The free foil end is held on the opposite side with a swivelable toe dog. The arrangement is mounted movably on a slide and is moved toward the bale in order to envelope it, simultaneously the pivoting lever makes a closing movement.

The known arrangement has a disadvantage as it is not completely automatic. The device has to be backed up from the wrapped bale with the pivoting lever opened once the wrapping is completed. Only after that, can the free end of the coil be connected to the toe dog again. The publication does not point out how this could be handled automatically. It is also disadvantageous that the jacket cannot be wrapped around the bale without wrinkles and that its tension over the width of the bale varies. This definitely requires the use of elastic, stretchable foils, which are not the optimal material for bale wrapping. In addition, the wrapped bales can only be hoop-cased once the wrapping device has moved back into its original position. Therefore the hoop-casing has to be an additional step. With regard to the resulting space requirements the realization of this wrapping device in a final compression station and its restricting supporting construction is more than questionable. All in all the known design is very complex, the operational safety is insufficient and the operation time ratio is unfavorable.

German Patent DE-OS 29 48 237 describes a bale compression device wherein the wrapping and the hoop-casing have to take place in separate stations outside the compression station. A movable foil carrier with two coils is provided for the wrapping of the bale. It wraps the jacket foil around the bale in a U-shape. For this purpose an additional and very complicated dolly and pressure ram system is required, by means of which the bale is held on a carousel table and turned from station to station on it. This arrangement cannot be realized with compression devices working with high pressure without a major density loss. Furthermore, this arrangement is also very complex and requires a long cycle time due to the use of different stations.

SUMMARY OF THE INVENTION

The present invention provides a device for the wrapping and hoop-casing of a bale in the compression station allowing for the wrinkle-free and tight wrapping of a jacket foil around the bale in a short period of time.

The process according to the present invention is for packaging pressed bales where the bale material is put into a press box and then pressed by a pressing means. The press box is then removed with the pressing means still pressing down on the bale material. Jacket material is then stretched across the bale and wrapped around the bale. The jacket material after being wrapped around the bale is held tightly against the bale by a tensioning device according to the invention and the ends of the jacket material are then welded together. All this is done while the bale material is still under compression by the press means.

This process according to the invention effects the wrapping of a jacket foil around the base, and the jacket foil is cut and welded symmetrically and quickly and evenly tensioned by means of novel wrapping device. The wrapping is wrinkle-free and its inner tension is even. Due to the arrangement of the device inside the compression station, the wrapping is very fast. The device according to the invention can even be retrofitted in existing compression stations as it requires very little space. This is even possible with carousel presses, whose available space is restricted even more due to the required support structures. The prior art devices either can not be used with carousel stations at all or only outside the compression station.

According to the invention the bale is hoop-cased as it is wrapped. This saves cycle time to a considerable degree and also safeguards the fitting of the jacket foil. Non-stretch wrapping materials, i.e. so-called ribbon-tissues, may be used.

In the wrapping device according to the invention the separating and welding device may take various forms; e.g. a simple heating wire device with a knife, a crimped band arrangement or such like. These devices are above all designed for stretchable and shrinkable foils, which are normally not a very good material for the wrapping of bales.

Thermal welding devices are not well suited for non-stretch materials such as ribbon tissues for a number of reasons. For one, the width of the devices requires a certain spacing of the seam from the bale. This spacing, which causes slack, can only be compensated for by stretchable and shrinkable foils, and cannot, however be compensated, by non-stretch materials. Also, the strength of a welding seam generated by a thermal welding device is not sufficient in tissues. These tissues, however, are the favorite wrapping material, which could so far only be used in the shape of sewn bags or of bags pulled over one another or as cloth folded around the bale.

In the wrapping device according to the invention the bales are not only wrapped with the material, but also welded to it quickly and safely, and the seam can be placed in the immediate vicinity of the bale. The ultrasonic welding process and the respective device can also be used successfully in connection with other wrapping devices. In addition it allows for point or line-shaped welding seams of the jacket foil with the lid and the bottom foils in the overlapping area. The arrangement of the lid and the bottom parts is not a requirement. The jacket foil may be wrapped around a naked bale.

The ultrasonic welding device can, depending on the design of the welding head, only weld together the two tissue or foil ends. Cutting requires an additional device, e.g. a knife. However, if the welding head has a blade and bevelled lateral flanks, the overlapping tissue or foil can be cut and, at the same time, the open ends can be welded together. Flank angles of 140° to 150° have proven useful in the special case of tissues. However, other materials can be worked with the ultrasonic welding device, stretchable foils in particular. The flank angle might have to be changed and optimized for these other materials.

At the welding point the ultrasonic welding device does not develop temperatures as high as thermal welding devices. It is therefore possible to wrap the jacket foil tightly around the bale end with the help of a tensioning machine and to arrange the welding seam very near to the bale. Therefore it is possible to wrap a non-stretch tissue without slack around the bale, and this is even possible with easily inflammable or other heat-sensitive materials. The simultaneous wrapping and hoop-casing of the bale has the additional advantage that the tension on the jacket foil is eased at the end of the bale, so that the tensile stress at the location of the welding seam is low.

According to the invention the wrapping process and the device allow for a faster removal of the bale from the press and therefore a further reduction of the operation time. For this purpose a removal device which is connected to the wrapping device is installed. By means of a double-coil arrangement, the wrapped bale is freely accessible one the tissue, or foil jacket, has been cut and welded together and can be removed. Therefore a withdrawal of the wrapping and/or hoop-casing device, as featured in the prior art, is unnecessary. The removed bale can be deposited immediately on a stationary transport device. It is also possible to move the removed bale with the wrapping device from the now empty press and to pass it on at a unloading station further away.

For a fast and simple removal, a swivelably and movably mounted lifting fork, is recommended. One the fork prongs are inserted into their grooves of the lower force plate of the press, the bale is removed by means of a simple tilting movement. If the removal device is equipped with a chain conveyor or another transport device with a height larger than that of the fork prongs, the bale may be deposited on it at the end of the swiveling motion and can be transported instantly.

Accordingly, it is an object of the invention to provide a method of covering a bale of material which has a first end, an opposite second end, side walls between said ends and a top and bottom which uses a covering material which is wound on a pair of reels and extends between the reels and which comprises moving at least one of the material and the bale relatively to each other, so as to cause the material between the reels to engage over the first end of the bale and then the sides and, thereafter, the material is engaged from each side to cause it to converge intermediate the second end. Thus joining the covering material together over the second end to close the bale. This can also advantageously be done at the same time as the covering material ends are cut away from the bale and joined together for use in the subsequent covering of bales.

A further object of the invention, is to provide an apparatus for covering bales which includes a winding device including spaced apart, substantially parallel, first and second rolls of bale covering material for the single covering material which is windable on each reel and extends therebetween. This is arranged adjacent a bale support for each bale such that there is relative movement between the bale support and the winding device in a manner to cause the covering material between the winding rolls to engage around the first end, sides, and converge at the second opposite end in an arrangement which includes a clamping and fastening means at the second end which closes and clamps the wrapping material of the bale, severs the material ends away from the bale and joins the severed ends of the wrapping material which is positioned between the rolls.

A further object of the invention is to provide an apparatus for covering bales which is simple in design, rugged in construction and economical to manufacture.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which a preferred embodiment of the invention is illustrated.

BRIEF DESCRIPTION OF THE DRAWINGS

In the drawings:

FIGS. 1 to 7 are side perspective views of a bale press with a wrapping device in different positions during the operating movement constructed in accordance with the invention;

FIG. 8 is a top view of a wrapping device according to FIGS. 1 and 7 but with a bale of rectangular cross section;

DETAILED DESCRIPTION OF THE PREFERRED EMBODIMENT

Figure 9:
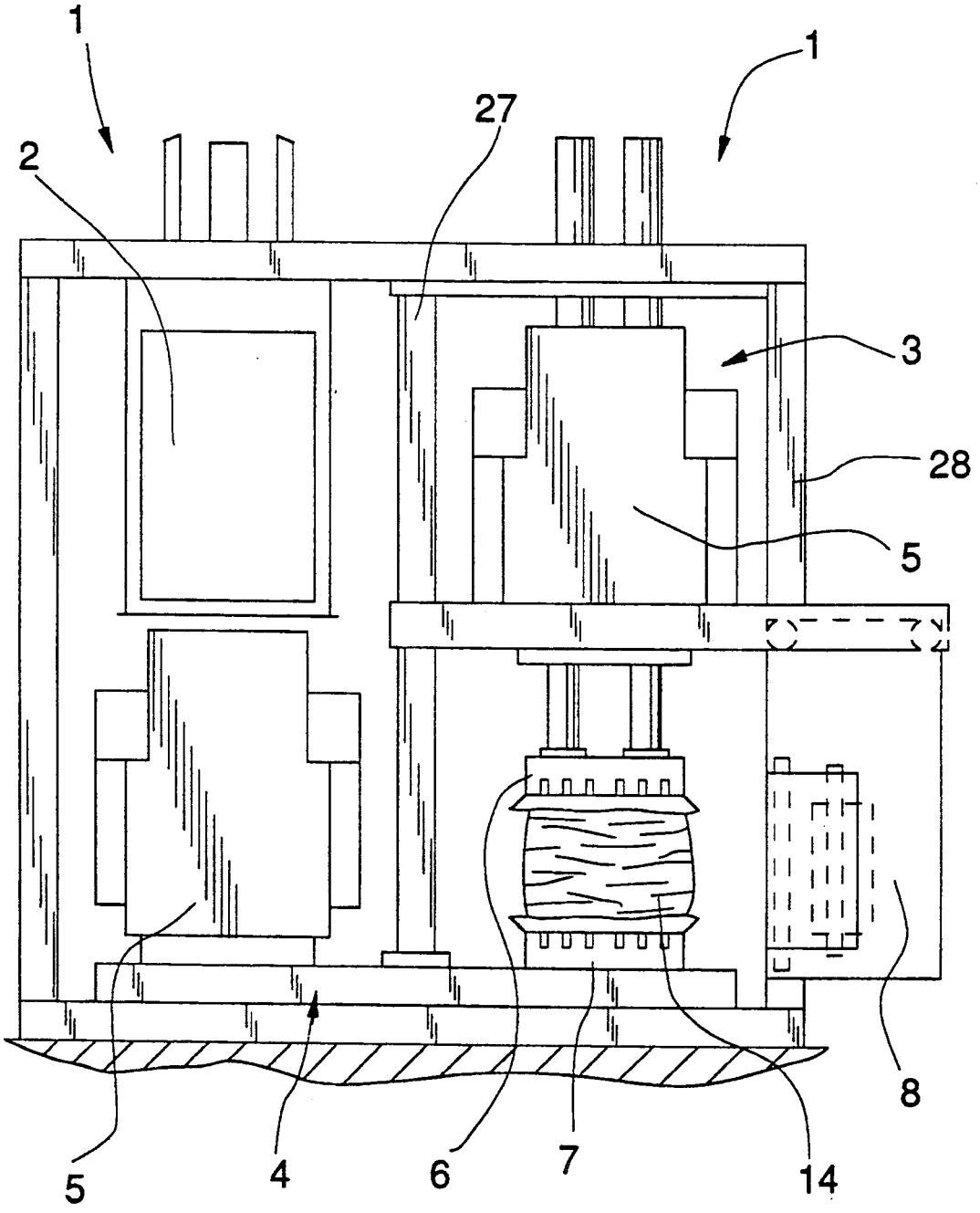
FIGS. 9 to 11 are views, similar to FIGS. 1 to 8, of various positions of a carousel bale press with an ultrasonic welding device of another embodiment of the invention.
Figure 10:
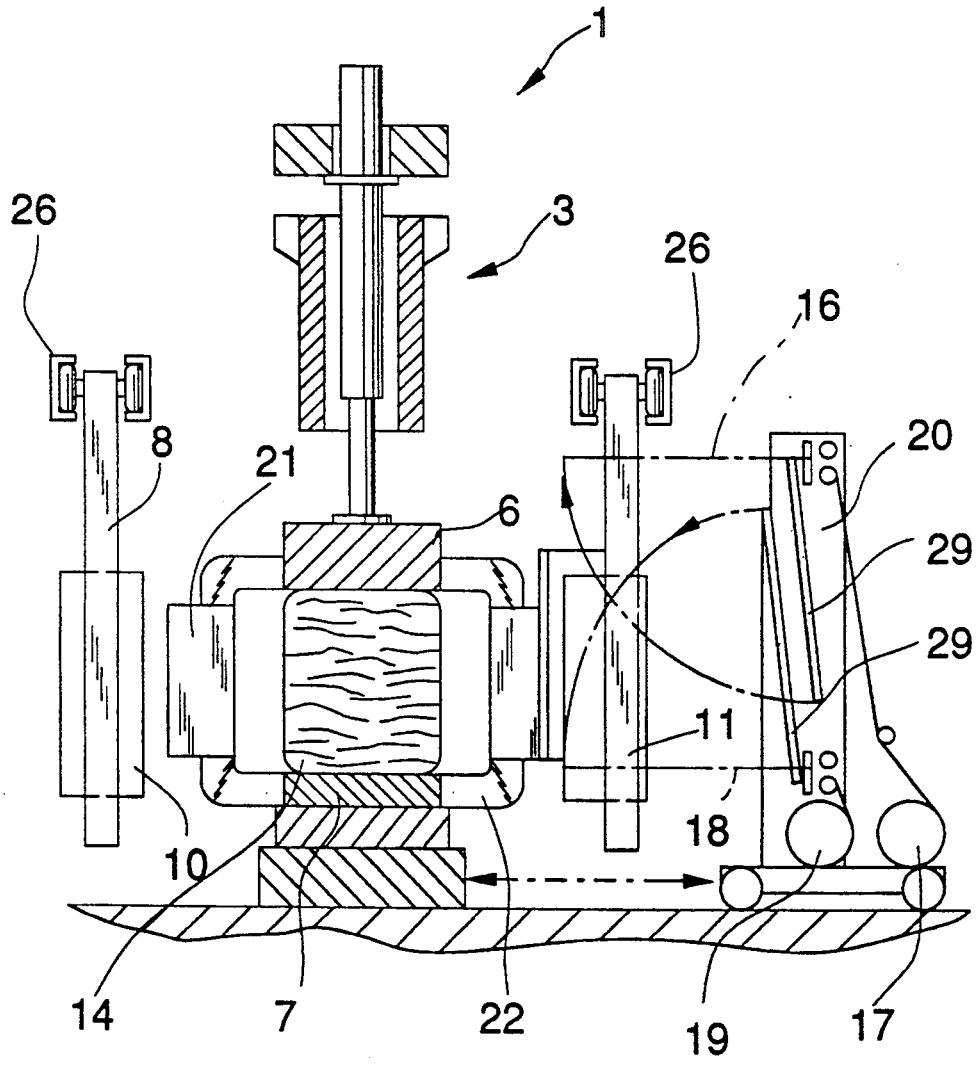
Figure 11:
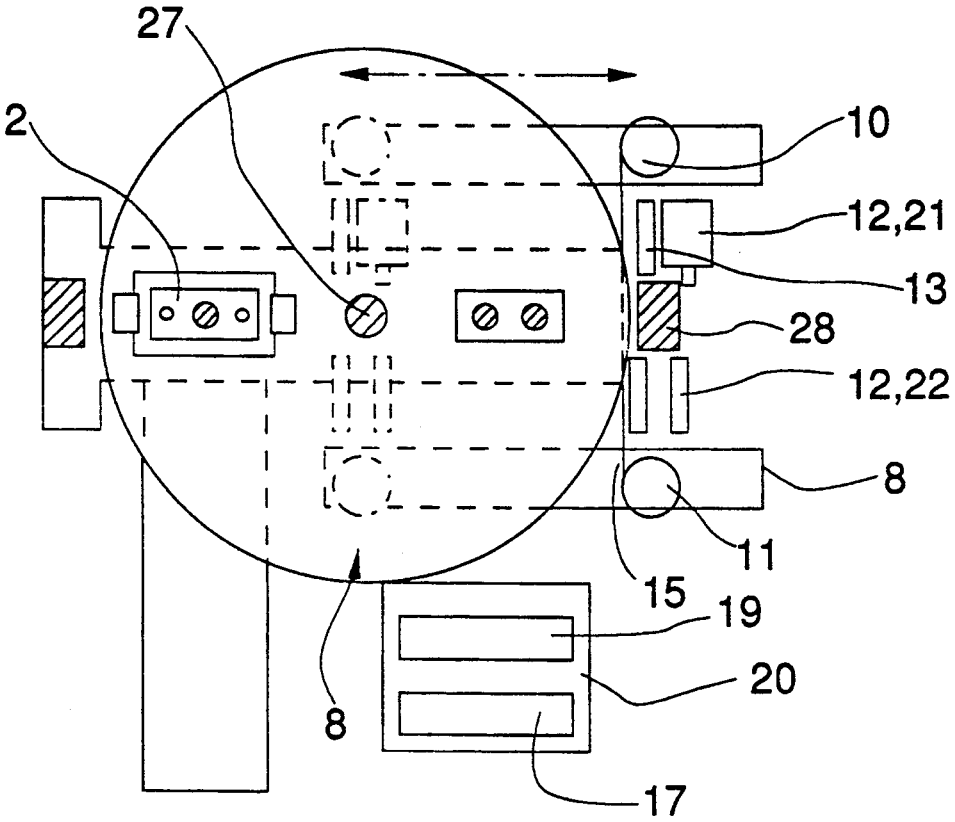

The drawings represent a bale press 1 and a multi-part bale compression device for pre-compression and final compression of bales 14 made of fibre material, which are then wrapped and hoop-cased by a wrapping device 8. The embodiment of the invention shown in FIGS. 1 to 6 shows a bale press device 1 with a press car 4 which is movable on rails, the press care 4 carrying a press box 5 for the reception of the bale 14. The embodiment of FIGS. 9 to 11 shows a bale press 1 in the shape of a carousel press 4, wherein the press boxes 5 are transported from the pre-compression station 2 to the final compression station 3 by a swivelable or rotatable carousel 4. The carousel press and its details correspond to German Patent DE-GM 79 07 579.

Figure 4:
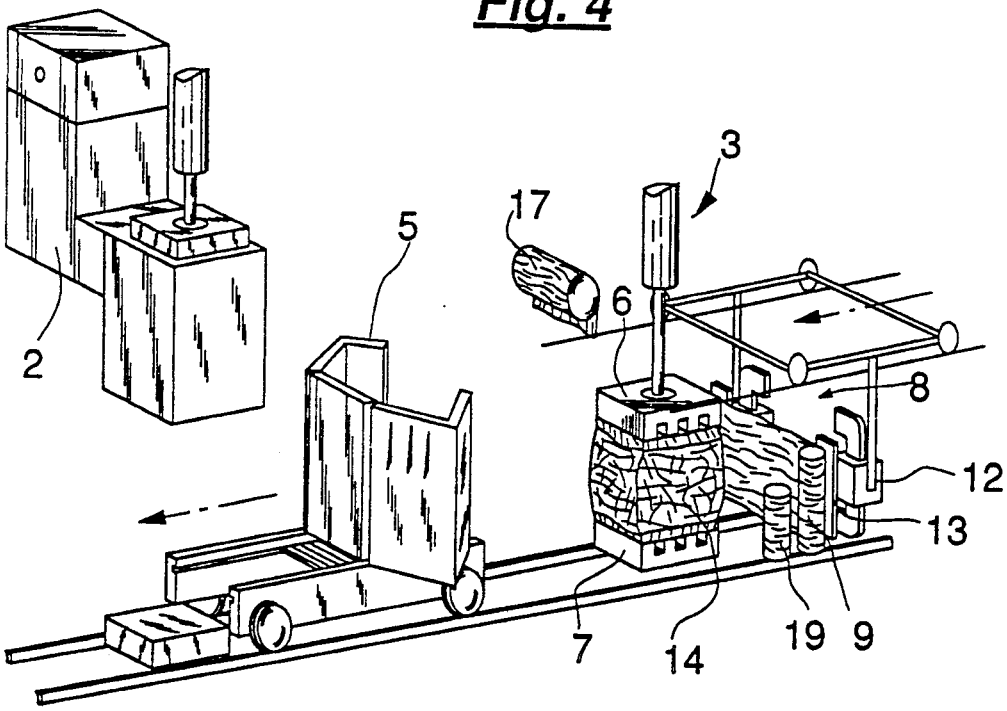

In both cases, fibre or other bale material is directed into a waiting press box 5 at a pre-compression station, and it is pre-compressed at a relatively low force of about 25 t. The press box 5 has withdrawable devices for keeping the fibre down, which stop the compressed material from squeezing out. The press box 5 is then moved into a final compression station 3 either by the press car 4 or carousel 15, and the bales 14 are compressed again in the press box 5 and upon removal of the press box 5 they receive a finishing compression under high pressure. In this position, as represented in FIGS. 4 and 10, the bale 14 is wrapped while being under high pressure between the two press pads 6 and 7.

The wrapping device 8 has a foil or tissue carrier 9, a hoop-casing device 12 and a cutting and welding device 13, which are mounted in a common housing or a trolley 47 and 48, (see FIGS. 18 to 21). The trolleys 47 and 48 can be moved with regard to the final compression station 3 on rails 26 or such like, which can either be suspended or on the floor. For the wrapping, a bottom 18 and a lid 16 are inserted between the press pads 6 and 7 and the bale 14, before the final compression, which presses into the top and the bottom of the bale. In this position they are covered sidewise by a jacket of material and surrounded and fixed by a hoop-casing. The bottom and the lid may be made from various non-stretch or stretchable materials, i.e. foils or tissues. In the following the generalizing term foils will be used. It is also possible to provide the bale with a jacket without using a bottom 18 or lid 16.

The wrapping process and the details of the wrapping device are described with the help of the FIGS. 1 to 7.

Figure 1:
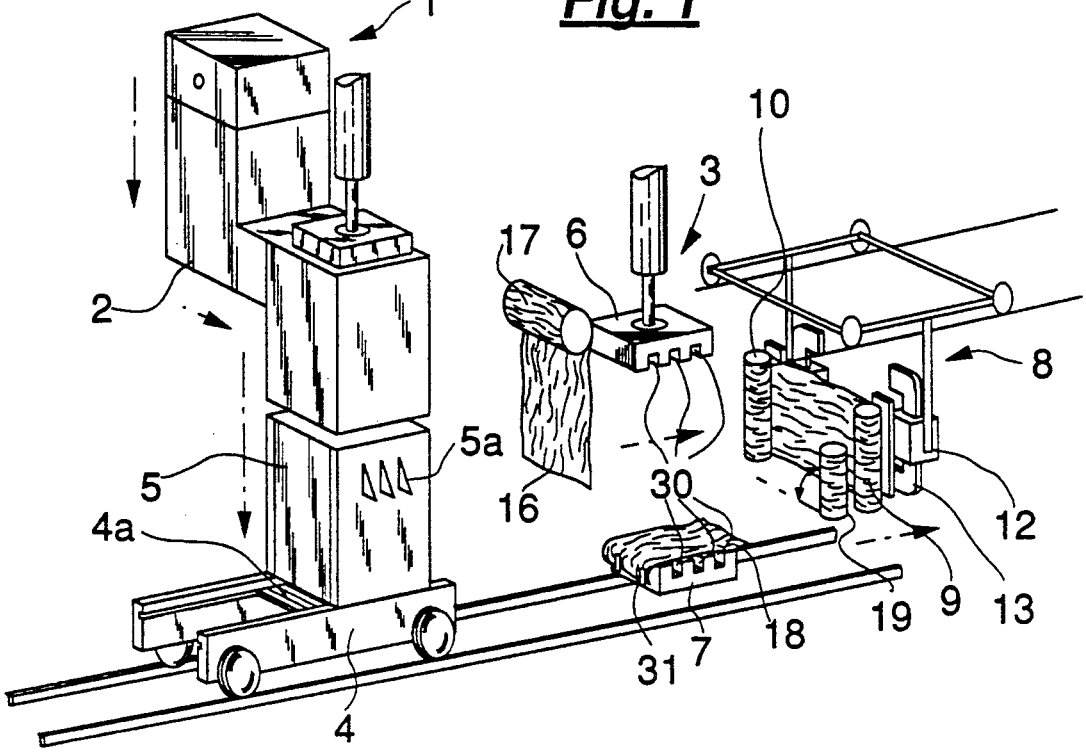
Figure 2:
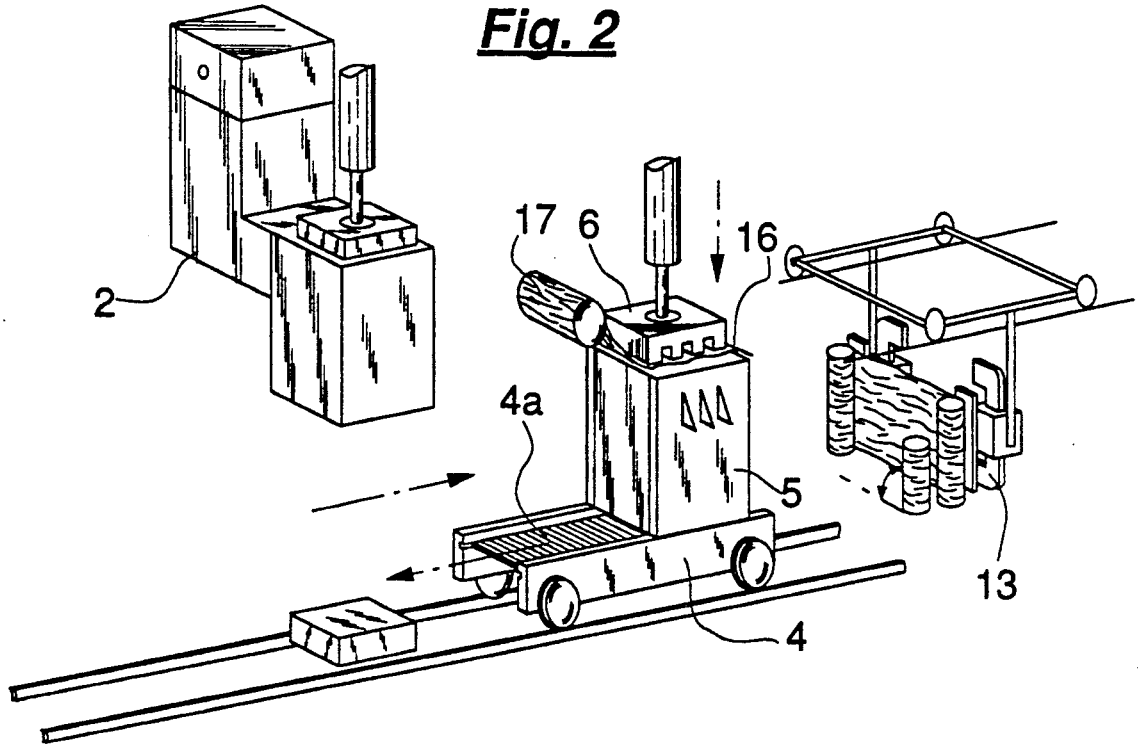

In FIGS. 1 a bale is prepared in the pre-compression station 2 while the compression station 3 is empty. The faces of the press box 5 are open, but during the pre-compression process the bottom side is closed by a sliding bottom 4*a* in the press car 4.

A lid winding device 17 is stationarily arranged at approximately the height of the lifted upper press pad 6 in the path of motion of the press car 4 and upstream of the final compression station. From the lid winding device 17 a piece of lid foil 16 hangs down into the path of motion of the press box 5, which will later on be the lid of the bale jacket. On the bottom press pad 7 a respective bottom foil 18 is deposited and kept in this position by a clamping device 31. The area of either foil is larger than their respective press pads and they will later on lie on the pads with their edges overhanging on all sides. The wrapping device 8 can be moved in the longitudinal direction of the press car rails. In FIG. 1 the wrapping device 8 is in a resting position outside the final compression station 3. After the pre-compression, the press car 4 with the press box 5 and the bale 14 are moved into the final compression station 3. Herein the press box 5 takes along the lid foil 16 and slides it below the upper press pad 6. Once the devices holding the material down and the sliding bottom 4*a* are removed, the faces of the press box are accessible, and the press pad 6 is lowered. The press pads 6 and 7 compress the bale 14 between one another under high pressure, the overhanging foils 16 and 18 being positioned between the press pads 6 and 7 and the bale 14. The lid foil 16 is cut from the winding device 17 before this process.

Figure 3:
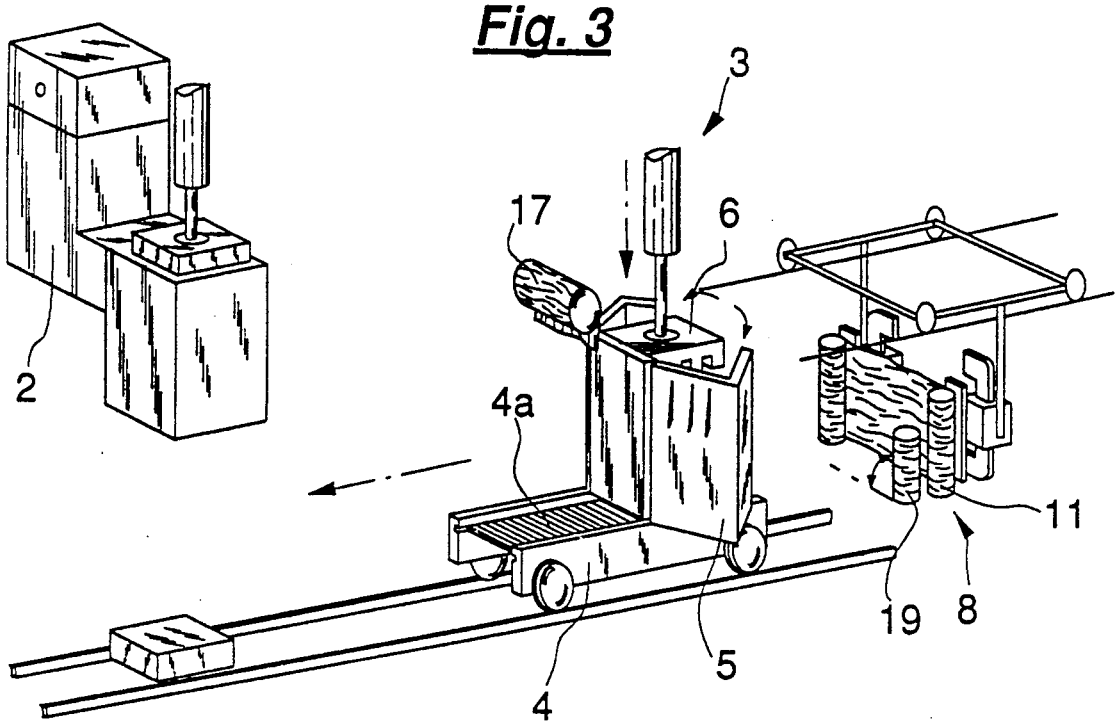

FIGS. 3 and 4 show the final compression position, wherein the bale 14 in the press box 5 is compressed so far that the press box 5 can be opened again and be removed with the press car 4. In the carousel press according to FIGS. 9 to 11 the press box 5 is removed overhead from the bale 14.

The finished wrap has to close in the compressed bale 14 tightly on all sides. For this purpose the overhanging edges of the foils 16 and 18 are smoothed onto the bale 14 and fixed through air pressure or by means of pins arranged between the channels 30 of the press pads 6 and 7. The pins are e.g. actuated and extended by hydraulic or pneumatic operating cylinders.

Then the wrapping device 8 is moved from its ready position toward the bale 14. FIG. 8 shows this process best. The foil carrier 9 has two vertical windings or coils 10 and 11. The distance between the two coils 10 and 11 is marginally more than the width of the bale, and between them a jacket foil 15 is extended and supported in the shape of a closed length of foil. The length of foil is wound up on the coils in opposed directions of rotation and are tensed by a tensioning device. The direction of rotation is arranged so that the foil is situated downstream of the wrapping device 8 behind the coils 10 and 11 in a delivery direction.

For the wrapping process the device 8 is moved from the position shown as a broken line toward the bale 14. Herein the jacket foil 15 is positioned against the back of the bale 14, so that in a continuation of the movement the jacket foil will be positioned in an U-shape around the bale 14. Behind the front-facing bale-end the jacket foil 15 is cut from the coils at the height of the middle of the bale, and at the same time the two ends are welding together and therefore the bale wrap is closed. At the same time the ends of the coiled foils which were cut loose are welded together, so that the foil between the coils 10 and 11 is connected again.

Figure 12:
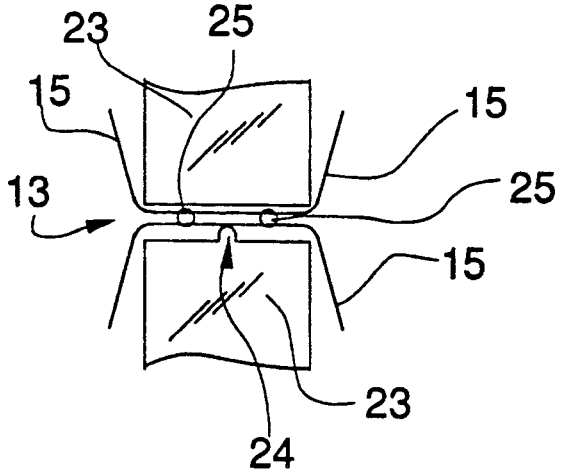
FIG. 12 is a magnified view of a cutting and welding device.

FIG. 12 shows the details of the cutting and welding device, which consists of two jaws 23, 23 moveable toward one another. During the wrapping of the bale 14 the jaws 23 are far apart and when the face end of the bale is reached they move toward one another. A cutting element 24 in the form of a protruding heating wire or a knife with which the two foil ends are separated is arranged about in the middle of one of the jaws 23. On both sides of the cutting element 24 heating wires 25 are arranged, which weld together the foil ends by working together with teflon surfaces on the other jaw.

The cutting and welding device 13 can also be a heated crimped band in a construction similar to the one in FIG. 12. The crimped band has a heating band which extends over the whole width of the jaw 23 with the central ridge 24. The are of the crimped band 7 is covered by a teflon band on both sides of the ridge with regard to the jacket foil 15. The other jaw 23 has a silicone-rubber layer, which is also completely covered by a layer of teflon. For the separation of the foil the crimped band 24 can be pressed a little into the silicone-rubber layer on the opposite side. At the same time the heating foils on both sides have full contact with the jacket foil 15 and provide a sufficiently strong welding seams.

In order to wrap the bale 14 the wrapping device is moved forward in steps corresponding to the distance between the channels 30 in the press pads 6 and 7. Also the hoop-casing device 12 is moved stepwise from channel to channel and with every step a hoop is laid through the channels 30 around the bale and the jacket foil 15, which has already been mounted. The hoop-casing device 12 has one or two hoop-casing heads 21 with respective baffle paths 22 on the other side of the bale. The wrapping device 8 will be moved by an operating actuator having very little slack, which is actuated by a stepping motor with programmable control. This actuator is described in detail in DE-OSD 34 32 832.

As shown in FIG. 8, the wrapping device 8 of the foil carriers 9, the cutting and welding device 13 and the hoop-casing device 12 are arranged with a small spacing between them in order for the hoop-casing device to substantially follow the wrapping device in tandem. The distance between the hoop-casing device 12 and the cutting and welding device 13 is adjusted with regard to the distance of the channels 30 to the bale edge, and the press pad edge. Due to this the last hoop can be laid and the jacket 15 can be closed in one step.

Figure 5:
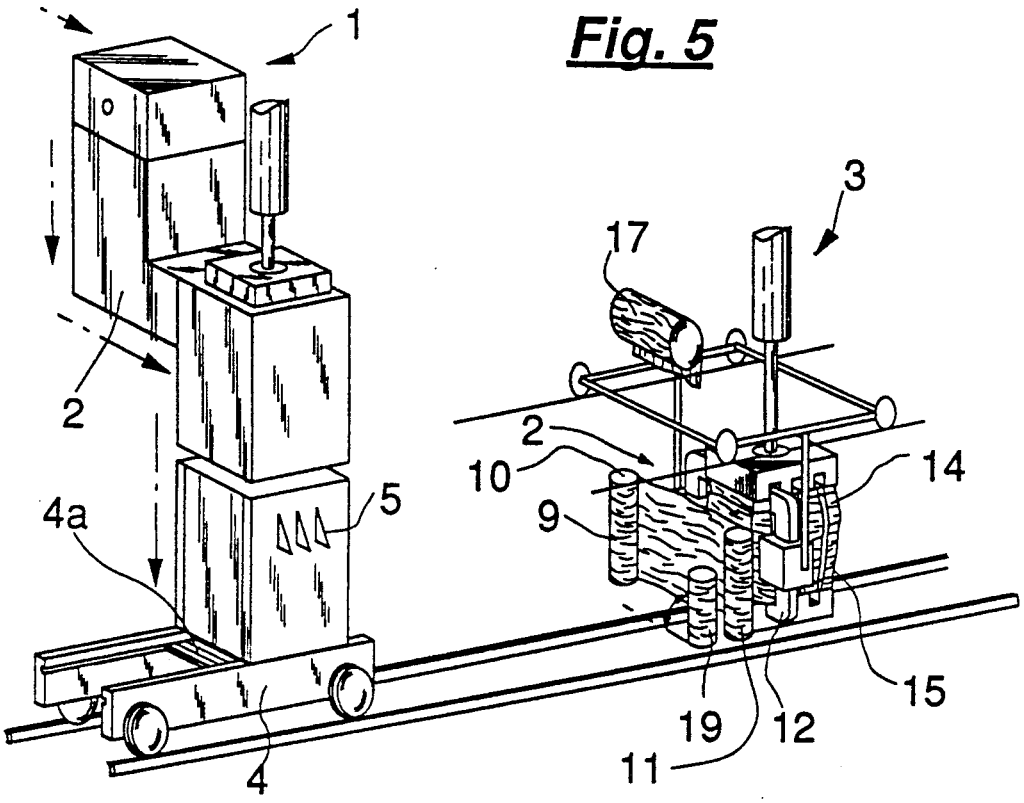
Figure 6:
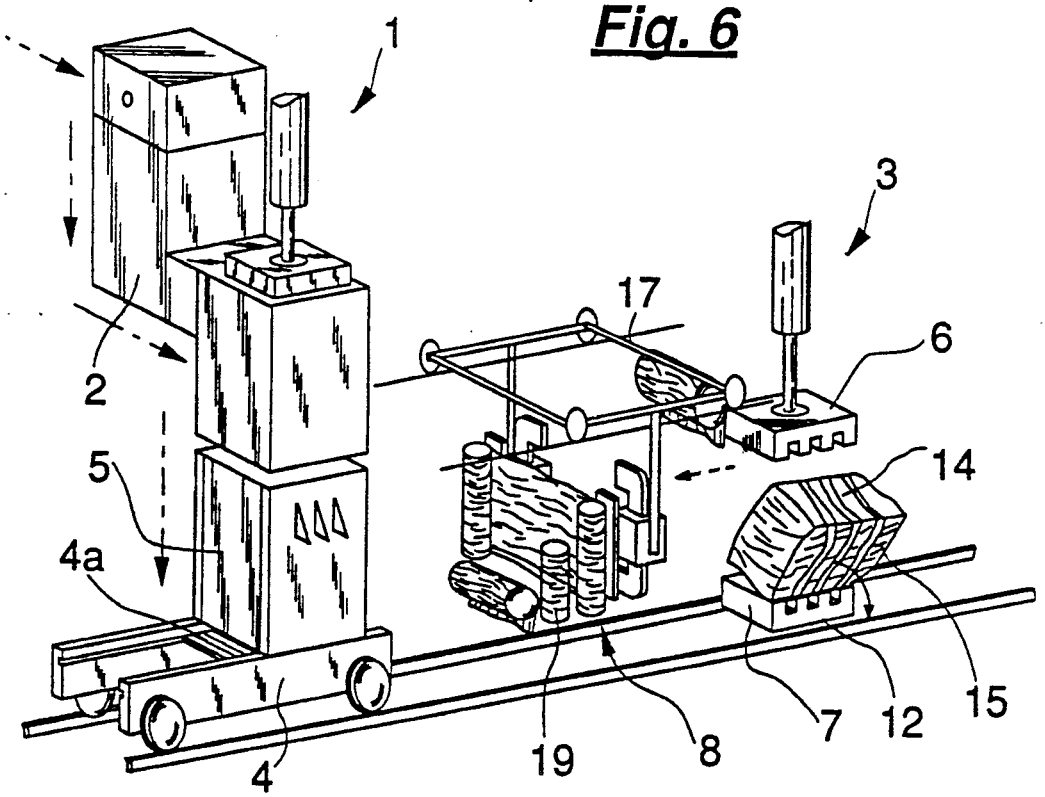

FIG. 5 shows the wrapping device 8 in this last working position according to FIG. 8. According to FIG. 6 the wrapping device moves even further and clears the final compression station 3. Once the upper press pad 6 is lifted the finished bale 14 which is now wrapped and hoop-cased can be removed and evacuated. This can be effected by an external removal device or by a removal device 49 which is moved along, according to the embodiments in FIGS. 18 to 21. In either case the wrapping device 8 moves back through he empty final compression station 3 into its starting position for the next wrapping operation (see FIG. 7).

FIGS. 1 to 7 show that for the application of the bottom foil 18, a bottom winding device 19 is mounted pivotally and has a vertical position during the wrapping process. Then the bottom winding device 19 rotates into a horizontal position according to FIG. 5 and unwraps a piece of the bottom foil 18 (see FIG. 6). When moving back into the starting position, the bottom foil 18 which hangs down is held by the clamping device 31, unwrapped and laid over the bottom press pad 7. FIG. 7 shows this position, in which also a piece of the lid foil 16 is unwrapped for the next wrapping operation. Once the bottom foil 18 has been cut, the bottom winding device 19 is rotated back into its vertical position, so that the wrapping device 8 is ready for the next wrapping operation according to FIG. 1.

The embodiment in the FIGS. 9 to 11 shows a bale compression device 1 in the form of a carousel press, wherein the press boxes with the bales 14 are rotated via a rotatable carousel 4 from the pre-compression station 1 to the final compression station 3. The wrapping device 8 and its guiding rails 26 are mounted inside the compression device frame. Due to the serial arrangement of its parts it can be moved back beyond the lateral post 28 of the compression device frame, and then only the tensioned length of fail is extended before the frame. The compression device area is therefore completely accessible from the side. At the other end of the building rails 26 the wrapping device 8 can move beyond a central column 27 of the carousel press. After the cutting and welding the tensioned foil stretches elastically, but loosely around the central column 27 and is tensioned again during the backward movement of the wrapping device 8 on guiding rails 26. In this end position, too, the compression device area is laterally completely accessible, so that the ready-wrapped device 8 described above allows a retrofit in any course press without major effort regarding the adjustment of press parts, transport devices and such like.

In the carousel press the lid and bottom foils 16 and 18 can be inserted in a way similar to the embodiment represented in FIGS. 1 to 7. For this purpose the lid winding device 17 is simply arranged in front of the upper press pad 6 in the area of rotation of the carousel 4.

FIGS. 10 and 11 show a further possibility for the insertion of lid and bottom, which can so be used in a sliding press according to the FIGS. 1 to 7. Next to the final compression device 3 a gripping device 20 is arranged movably, which has pivoting positioning arms 29 with cutting devices, the arms being supplied with the lid and bottom foil 16 and 18 from the lid and bottom winding devices 17, 19. Once the last bale 14 is removed and the wrapping device 8 has returned to its starting position, the gripping device 20 moves from the side into the press area and holds the ready cut foils 16, 18 over and below the press pads 6, 7 respectively. The positioning arms have a fork shape and spread out the foils 17, 18 between them.

First the bottom foils 18 is positioned on the empty bottom press pad 7 and fixed by clamping means or such like. Then the lifted press box 5 is let down again and the carousel 4 makes a 180° turn. The empty press box 5 with the inserted bottom foil 18 is then filled in the pre-compression station 2 and is pre-compressed while a pre-compressed bale 14 with the bottom foil 18 already inserted reaches the final compression station 3. If necessary, the gripping device 20 has moved back briefly during the rotation of the carousel. It is then repositioned again and holds the lid foil 16 under the upper press pad 6 with its upper positioning arms 29. Once the press pad 6 is lowered, it carries along the lid foil 16 and presses it onto the bale 14. The gripping device 20 moves out of the press area and into its starting position. Once the final compression is finished, the press box 5 is pulled off the bale 14 overhead and the wrapping process takes place in the described manner.

FIGS. 13 to 17 show another version of the cutting and welding device 13, which is hereby equipped with an ultrasonic welding device 33 and a tensioning device 32.

Figure 13:
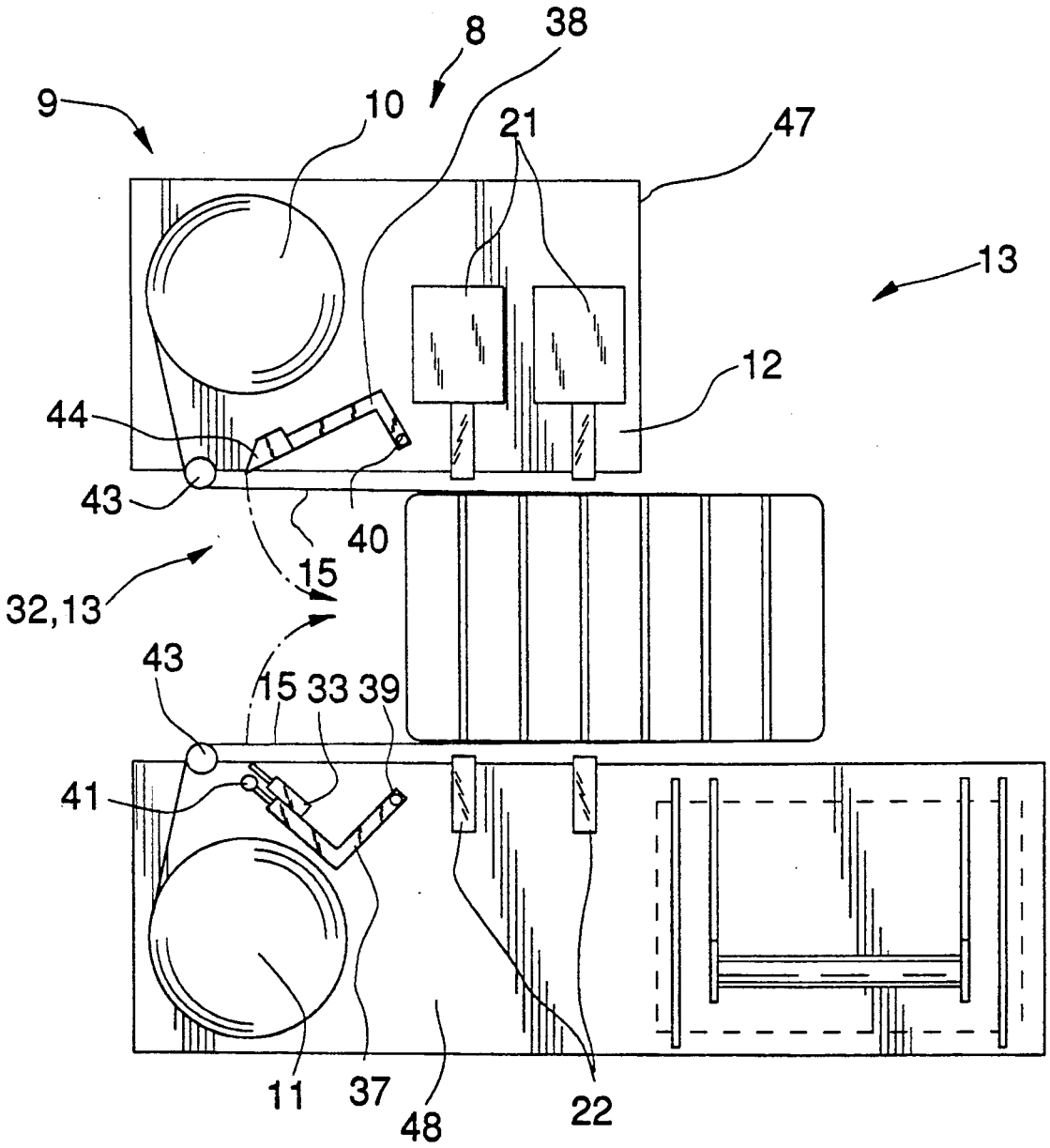
FIGS. 13 to 17 are various, enlarged views of a cutting and welding device comprising an ultrasonic welding device.

The top view according to FIG. 13 represents the position of the various device elements before the beginning of the cutting and welding process. Here the wrapping device 8 and the hoop-casing device 12 are mounted on two trolleys 47, 48, which can be moved synchronically on both sides of the bale on ground rails. In contrast to FIG. 8, which shows a foil carrier 9 unwrapping on the right coil-side, the jacket material 15 in FIG. 13 is unwrapped on the left side of the coil 10, 11 and it is diverted via tensioning rollers 43 into a position parallel to the longitudinal sides of the bale 14. FIG. 13 shows the final position of the wrapping device 8 in which the two last hoops are placed and in which the U-shaped jacket material 15 extends longitudinally beyond the bale end.

The cutting and welding device 13 is again arranged between the coils 10, 11 and the hoop-casing device 12. The tensioning device 32 comprises two pivoting arms 37, 38 rotating around vertical axes 39, 40 on the trolleys 47, 48. Both pivoting arms 37, 38 are bent or curved and rotate together toward the bale middle while carrying along the jacket material 15, which runs along in front of them.

Figure 14:
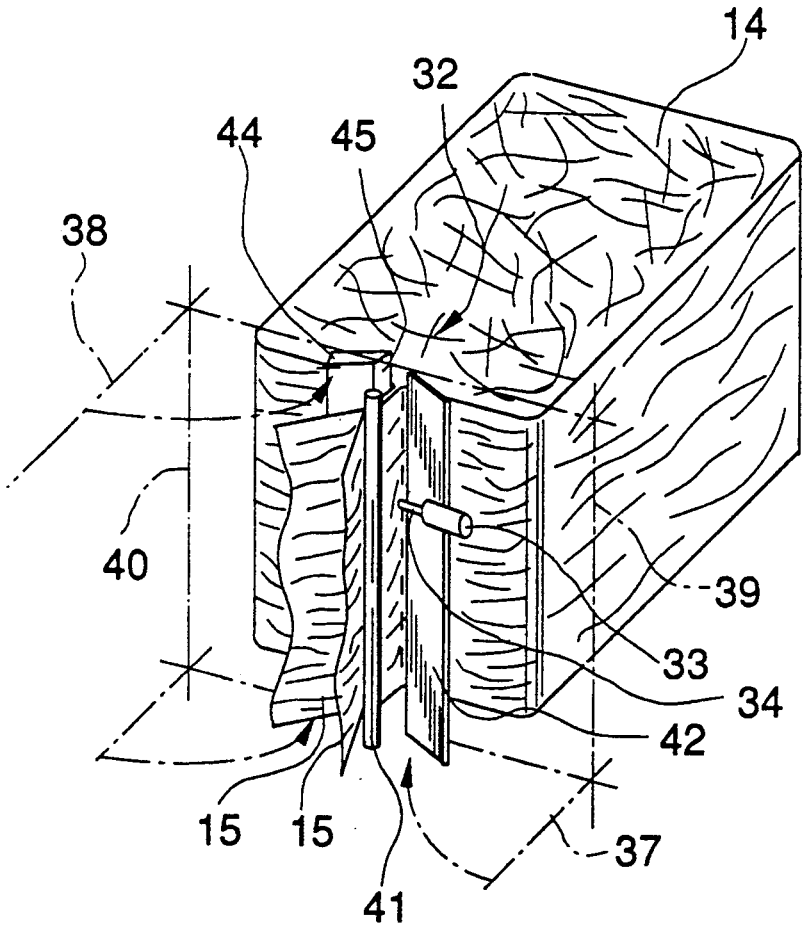
Figure 15:
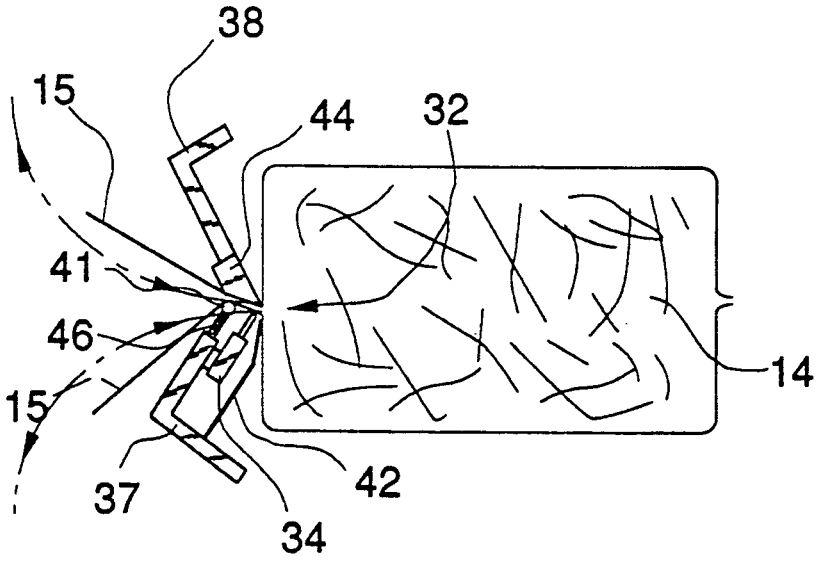
Figure 16:
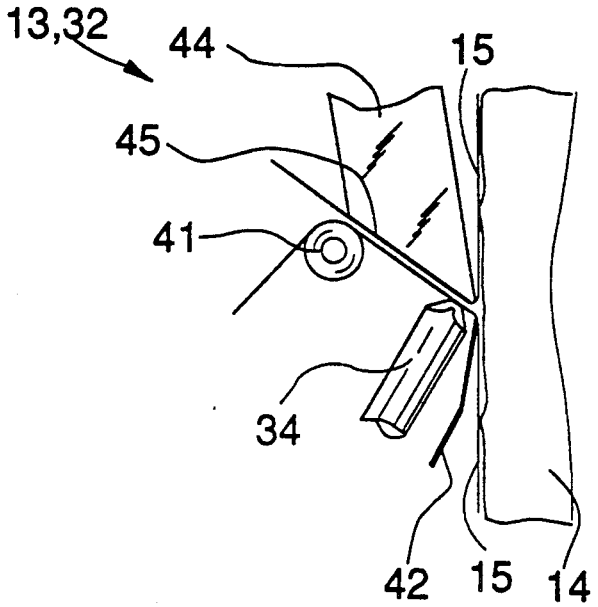

The details can be seen more easily in the perspective view of FIG. 14 and the top view of FIGS. 15 and 16. The end of the pivoting arm 37 carries the ultrasonic welding device 33, which is height adjustable by an actuation means not shown and a respective guide. In addition the pivoting arm 37 comprises a guiding sheet metal 42 which is bent at the end and a pressing roller 41, which is mounted adjustably at the end of the arm via a spring 46 (see FIG. 15). The pivoting arm 38 has a knife 44 at its free end, which has a bevelled pressing surface 45, preferably from hardened steel, as a counter-working surface for the ultrasonic welding device 33. According to FIG. 14, the parts 41, 42 and 44 are longer than the bale and protrude over its bottom surface and its lid surface.

FIGS. 14 to 17 show the cutting and welding position. During the folding-in movement the guiding metal sheet 42 and the pressing roller arranged 42 opposite the ultrasonic welding device 33 on one side and the knife 44 on the other side carry along the jacket material 15 and smooth it around the corners and the back of the bale 14. Herein the two foil ends are led together by the sharp edges of the knife 44 and the guiding sheet metal 42, they meet in the middle of the bale and immediately on the bale surface and then they are led overlapping along the pressing surface 45 and away from the bale 14 at an angle. Via the spring-biased pressing roller 41 the two foil ends are pressed against the pressing surface 45 and upon leaving it they are led apart again.

FIG. 16 shows clearly in magnified view that the ultrasonic welding device 33 with its welding head 34 in working position is preferably positioned at a right angle with regard to the pressing surface 45. Furthermore, the welding head 34 is in the immediate vicinity of the bale-near edges of the guiding sheet metal 42 and the knife 44 and therefore also very near to the bale surface itself. Therefore the two foil ends 15 do only stick out a short piece from the bale edge to the cutting and welding point. Once the material ends are cut and welded the jacket material 15 sits around the bale 14 basically without slack.

Figure 17:
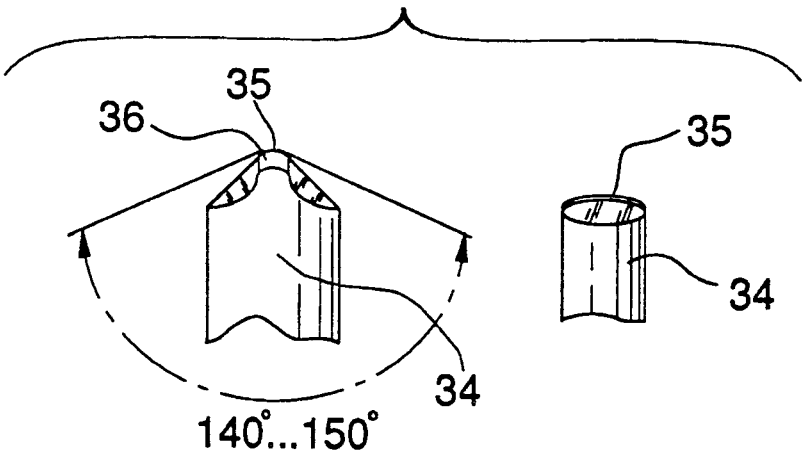

The welding head 34 comprises a cylindrical shaft which has a central and vertical cutting edge 35 with laterally bevelled flanks 36 (see FIG. 17). The two flanks 36 are arranged at a blunt angle, which should range between 140° and 150° for ribbon tissues or similar material. With this flank geometry the overlapping foil or tissue 15 can be cut and the open ends can be welded together in one step. After a bevelled free punch, the flanks 36 level out into the shaft of the welding head 34. As is shown in lateral view on the right side of FIG. 17, the cutting edge 35 is crowned in longitudinal direction. The flanks have a working temperature of 90° and the cutting edge 35 has a temperature of about 140°.

The welding head, similar to the pressing roller 41, is mounted with a spring bias and is pressed on with constant force. During its movement it can follow bumps in the jacket material 18 and guarantee a correct cutting and welding even in these places. This is especially advantageous with ribbon tissue, who surface is relatively uneven. The bias of the pressing roller 41 compensates for a varying bale thickness or other irregularities in the final position of the tensioning device 32 and secures the overlapping position of the tissue or foil ends on the pressing surface 45.

Alternatively the welding head 34 may also have a flattened face instead of the cutting edge 35. In this case it serves for the welding of the material only. The cutting of the jacket material 15 is effected through a different device, e.g. a cutting knife. Furthermore the ultrasonic welding device 33 can have a long-stretched welding head 34 and it can be mounted stationarily.

In addition an ultrasonic welding device 33 can be used for the tack-welding stitch welding of the jacket material 15 to the lid and bottom parts 16, 18 and be equipped with a respective drive.

Figure 18:
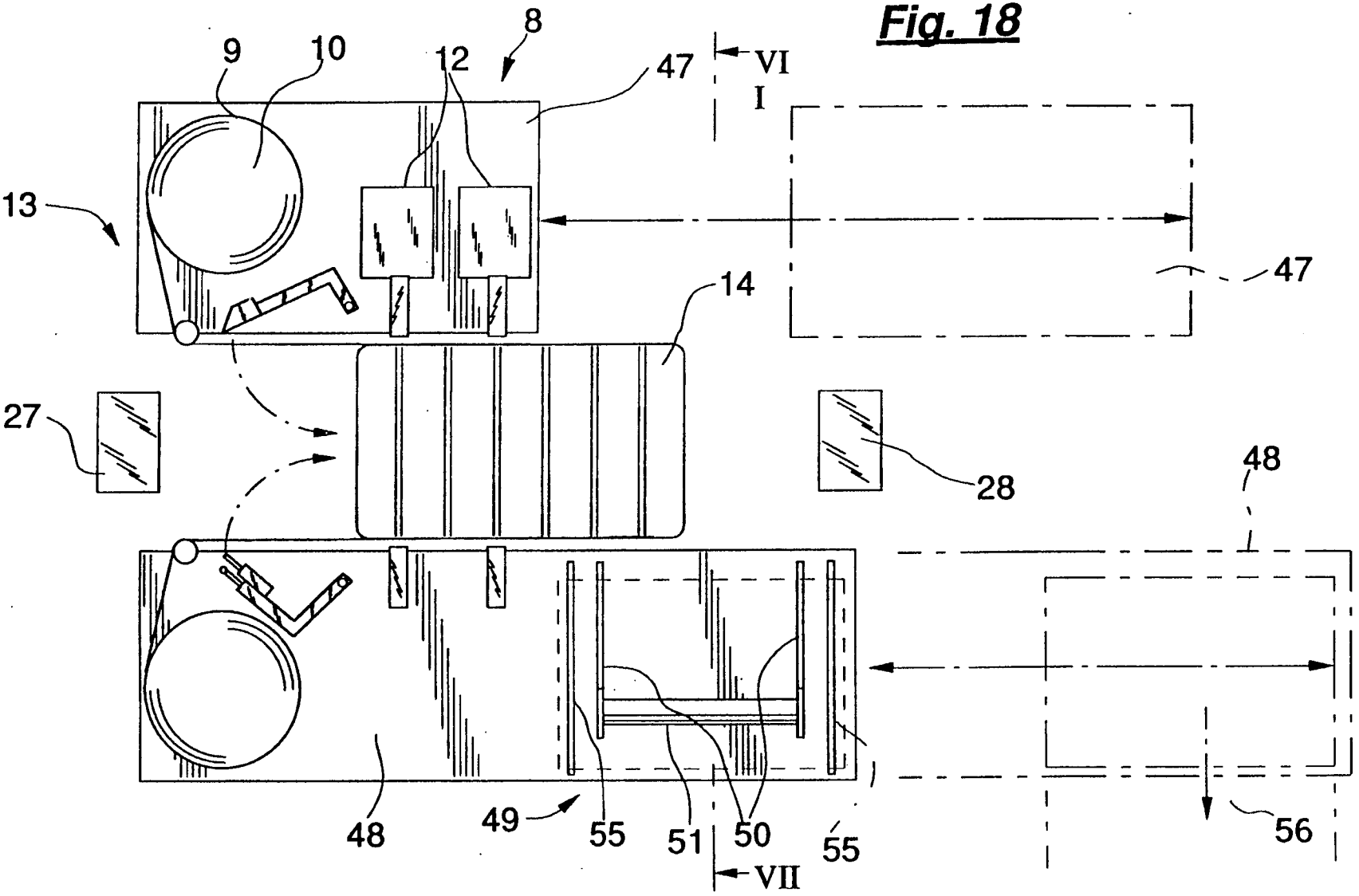
FIGS. 18 to 20 show various variations and representations of a removal device for the pressed bales.
Figure 19:
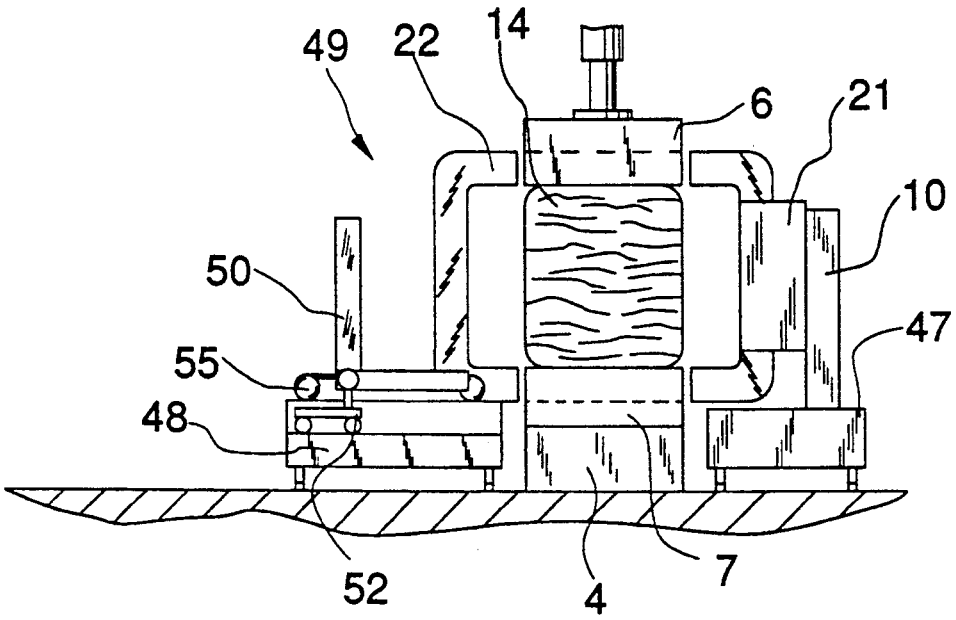
Figure 20:
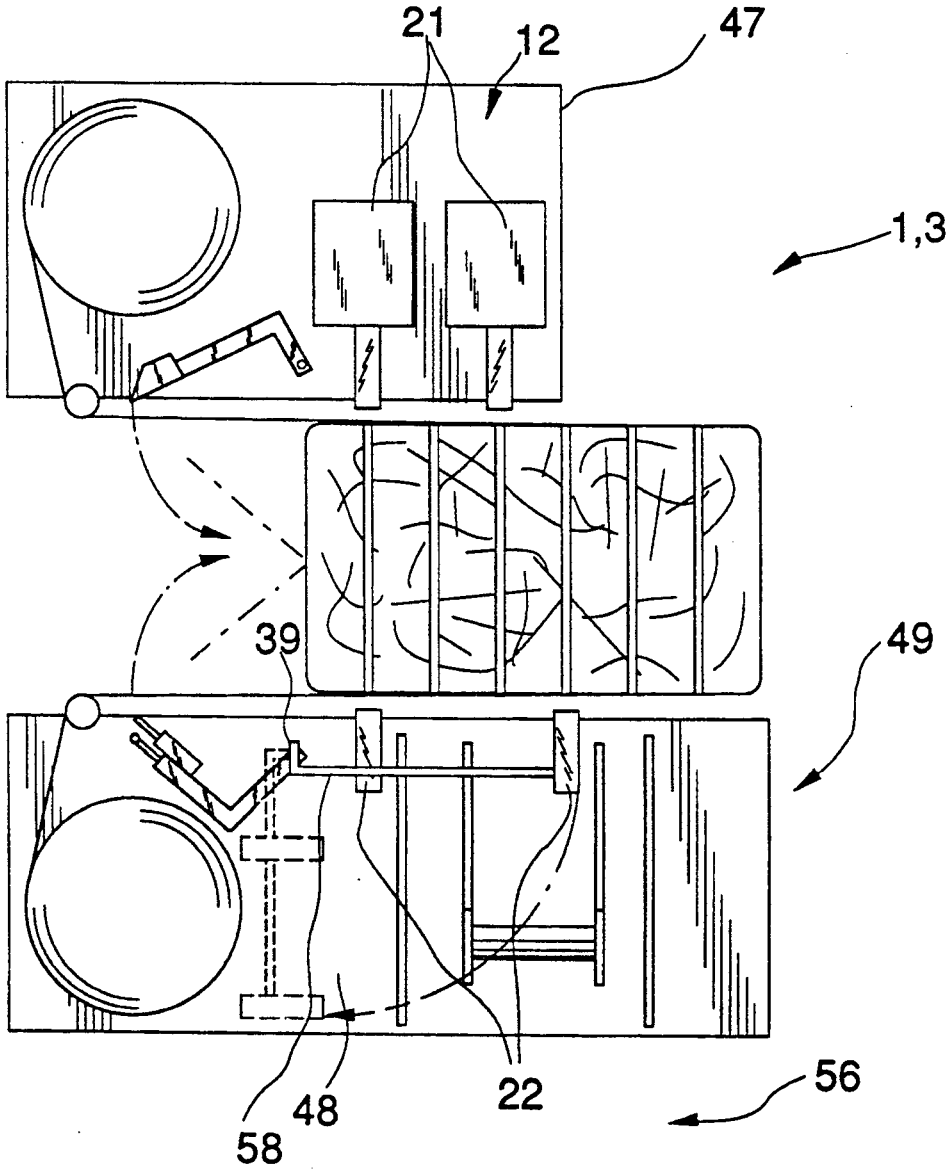
Figure 21A:
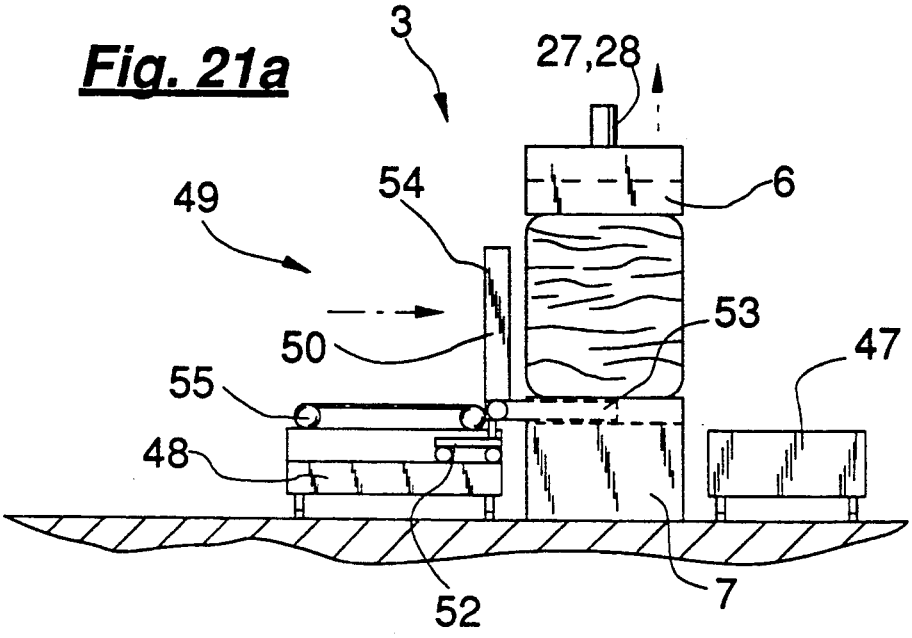
FIGS. 21*a*, 21*b*, 21*c* and 21*d* are side elevational views showing various operational positions.
Figure 21B:
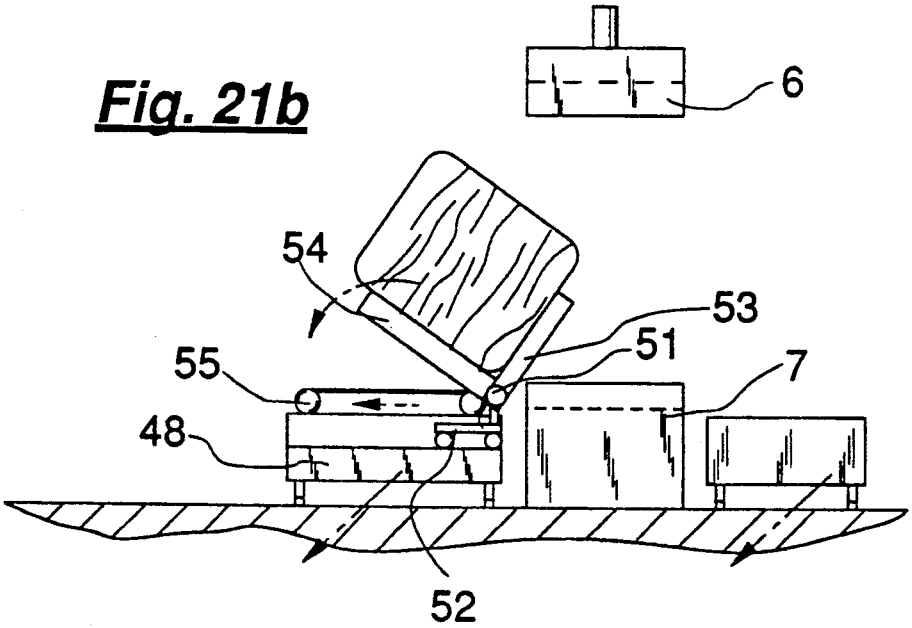
Figure 21C:
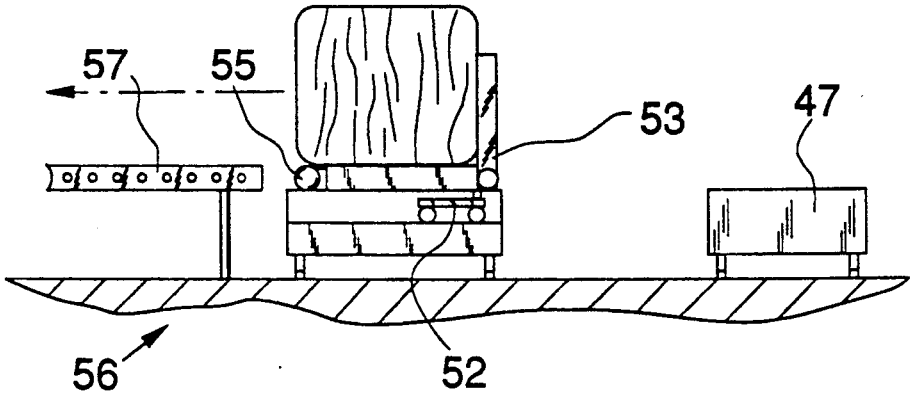
Figure 21D:
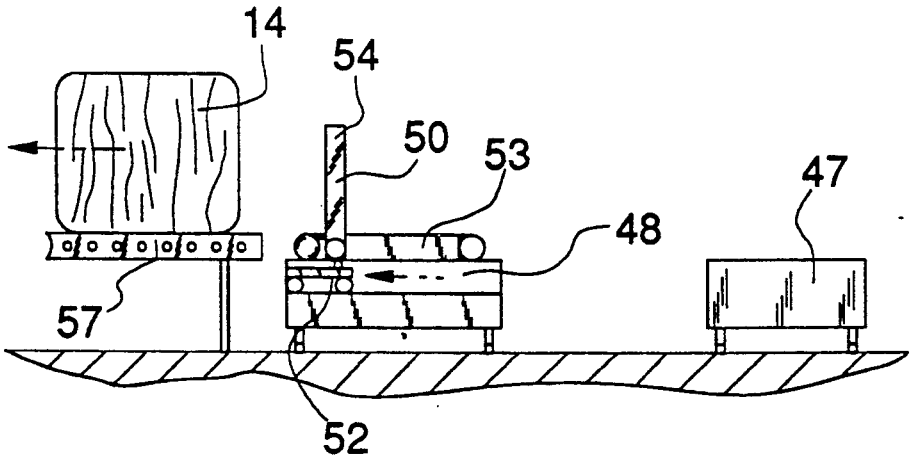

FIGS. 18 to 20 represent the additional arrangement of a removal device 49 on the wrapping device 8. Herein FIGS. 18 and 20 show two different executions in top view, while FIG. 1 shows a section along the line VII—VII of FIG. 18. FIGS. 21 *a–d* shows the schematic operation of the removal device 49.

In both executions the removal device comprises a loading fork 50 with L-shaped prongs 53, 54 whose distance between similar prongs corresponds to the distance between the channels 30 in the bottom press pad 7. In order to pick up the bale 14 the horizontal prongs 53 can move into the mentioned channels 30. The loading fork 50 is mounted rotatable around a horizontal swivelling axis 51 in longitudinal direction at the bridge connecting the prongs 53, 54. To this end it is mounted on a slide 52 movable at a right angle with regard to the moving direction of the trolley 48. The loading fork 50 can move its horizontal prongs 53 into the channels of the press pad 7 by means of the slide.

On both sides of the loading fork 50 a chain conveyor 55 is arranged, whose height exceeds the height of the prongs 53, 54 by a little. The chain conveyor also operates at a right angle with regard to the direction of movement of the trolley 48.

In the shown embodiments the removal device 49 is arranged on one of the trolleys 48 in the immediate vicinity of and behind the hoop-casing device 12, and in particular the baffle paths 22. Upon finishing the wrapping of the bale, i.e. the wrapping and hoop-casing and the cutting and welding of the jacket 15 the wrapping device 8 moves forward a bit further, until the removal device 49 can move in front of the bale 14 from which the upper press pad 6 has been removed in the meantime.

In the execution according to FIG. 20 this movement is unnecessary as here the removal device 49 is arranged overlapping with the hoop-casing device 12. For space reasons the two baffle paths 22 should be on this side. The hoop-casing device 12, is mounted swivelably through a vertical axis 39 on the trolley 48, and can also be adjusted in height, if necessary. For the removal of the bale 14 it can be swivelled into the position marked by broken lines. For this purpose the two baffle paths 22 are connected to one or several bows, hoops, or shackles 58. For practical purposes the same axis 39 is used for the pivoting arm 37 of the tensioning device 32 and the hoop-casing device. The fork prongs 53 and the baffle paths 22 are staggered with regard to one another. Herein it is also desirable to choose the distance for the baffle paths 22 and the hoop-casing heads 21 larger than in the other embodiments. Once the last hoop is positioned, the fork prongs 53 are brought to coincide with the respective channels and can therefore move into them with the hoops.

FIGS. 21 *a–d* show the bale removal in schematic face views from the top to the bottom of the page. For the removal, the load fork 50 moves under the bale 14 by means of the slide 52. According to the second drawing the loading fork 50 is rotated around it swivelling axis 51, the bale 14 being supported by all prongs 53, 54. In this partially tilted position the fork 50 is no longer engaged with the bottom press pad 7 and the trolleys 47, 48 can move back, returning to their starting position. At the end of the rotating movement according to the third drawing the bale 14 sits on the chain conveyor 55. In the embodiment of FIG. 20 the chain conveyor 55 can unload the bale 14 immediately onto a stationary conveyor 57, e.g. a roller conveyor. In this case the unloading station 56 is inside the final compression station 3. The removal device may also move out of the press with the bale 14, as is shown in FIG. 18. In this case the unloading station 56 is at the starting point of the trolley 48 outside the press station 3.

Once the loading fork has unloaded the bale 14, it moves back into its starting position, at the same time the slide 52 moves back from its position near the press into its starting position which is shown in the fourth drawing. The removal device 49 is now ready again and can be moved forward with the wrapping device 8 during the next wrapping process.

While specific embodiments of the invention have been shown and described in detail to illustrate the application of the principles of the invention, it will be understood that the invention may be embodied otherwise without departing from such principles.

We claim:

1. The process for packaging material into pressed bales, the process comprising the steps of:

adding the material to a press box;

compressing the material inside said press box with a stationary press means at a press station;

removing said press box from the material, the material still being compressed by said stationary press means at said press station;

tensioning a jacket material between two coils of said jacket material;

moving in a substantially straight direction said jacket material relative to and along two sides of the compressed material, still compressed by said stationary press means at said press station, in order to surround the compressed material with said jacket material;

moving a hoop-casing means in a direction substantially similar to said moving of said jacket material, said moving of said hoop-casing means being initiated after said moving of said jacket material and before said jacket material is returned to a starting position, said hoop-casing means moving relative to the compressed material for applying a hoop around the material still compressed by said stationary pressing means at said press station; and combining ends of said jacket material after said surrounding of said compressed material for producing a packaged pressed bale.

2. A process in accordance with claim 1, wherein:

said combining of said jacket material is performed by welding said jacket material in a middle of one side of said compressed material and said tension jacket material is cut off from said two coils of jacket material.

3. A process in accordance with claim 1, wherein:

said substantially tandem moving of said jacket material and said hoop-casing device was performed in steps, and after each of said steps is positioned.

4. A device in accordance with claim 1, wherein:

said combining of said jacket material is performed by ultrasonic welding.

5. A process in accordance with claim 2, wherein:

said jacket material is cut off by means of ultrasonics at substantially a same time as said welding of said jacket material.

6. A process in accordance with claim 2, wherein:

said tensioned jacket material is closed to the compressed material during said combining.

7. A process in accordance with claim 1, further comprising:

removing said stationary press means at said press station from said packaged pressed bale; and moving the packaged pressed bale away from said stationary press means and over to an unloading station.

8. A process in accordance with claim 1, wherein:

said moving of said hoop-casing material is performed in a substantially tandem manner with said moving of said jacket material.

9. A process in accordance with claim 1, further comprising:

pre-pressing said material in said press box at a pre-compression station before said compressing with said stationary press means at said press station.

10. A process in accordance with claim 9, further comprising:

a plurality of said pre-compressing stations delivering a plurality of said press boxes to said stationary press means for said compressing.

11. A device for packaging material into pressed bales, the device comprising:

a pressing box for containing the material;

stationary press means at a press station for compressing the material contained in said pressing box;

pressing box removal means for removing said pressing box from the material while said stationary press means at said press station still compresses said material;

wrapping means for surrounding said material, still compressed by said stationary press means at said press station, with a jacket material;

hoop-casing means for applying a hoop around the material still compressed by said stationary press means at said press station; and movement means for first moving said wrapping means and then moving said hoop-casing in a substantially straight direction relative to and along two sides of the material still compressed by said press means, in order for said material, still compressed by said press means, to be surrounded with said jacket material and applied with hoops during said movement, said movement means moving said hoop-casing means after said first moving said wrapping means and before said wrapping means is returned to a starting position.

12. A device in accordance with claim 11, wherein:

said press means has a channel and the distance between said channel and an edge of the press means is substantially coordinated with a distance between said wrapping means and said hoop-casing means.

13. A device in accordance with claim 11, further comprising:

a gripping means for inserting bottoms and lids into said press box, said gripping means is arranged movable with regard to said wrapping means.

14. A device in accordance with claim 11, further comprising:

press car means for moving said press box to said stationary press means;

a lid winding device stationarily arranged in a path of said press car means; and a bottom winding device swivelably mounted on said wrapping means.

15. A device in accordance with claim 11, further comprising:

a cutting and welding means for combining said jacket material after said jacket material surrounds said compressed material.

16. A device in accordance with claim 15, wherein:

said cutting and welding means has two movable jaws having heating wires on two sides of a cutting element.

17. A device in accordance with claim 15, wherein:

said cutting and welding means has an ultrasonic welding device.

18. A device in accordance with claim 17, wherein:

said ultrasonic welding device has a welding head with a vertical cutting edge and laterally bevelled flanks.

19. A device in accordance with claim 18, wherein: said flanks enclose between one another an angle between 140° to 150°.

20. A device in accordance with claim 15, wherein: said ultrasonic welding device is height adjustable and has a crowned cutting edge.

21. A device in accordance with claim 15, wherein: said cutting and welding means has a swivelable tensioning device which keeps said jacket material near to the compressed material at a welding spot, clamps two ends of said jacket material together and leads overlapping edges of the jacket material away from the compressed material.

22. A device in accordance with claim 21, wherein: said tensioning device has two pivoting arms swivelably mounted around a vertical axis on two sides of the compressed material, one of said pivoting arms carries an ultrasonic welding device, a pressing roll and a guiding metal sheet, the other of said pivot arms carries a knife with a bevelled pressing surface.

23. A device in accordance with claim 21, wherein: a removal device is arranged at said wrapping means.

24. A device in accordance with claim 23, wherein: said removal device has a swivelable loading fork with L-shaped prongs being arranged movably on a slide.

25. A device in accordance with claim 24, wherein: a chain conveyor is arranged in an area of said L-shaped prongs, said chain conveyor is higher than said L-shaped prongs.

26. A device in accordance with claim 24, wherein: said removal device is arranged in a vicinity of said hoop-casing means, and said hoop-casing means is movable away from said removal device.

27. A device in accordance with claim 11, wherein said movement means moves said wrapping means and said hoop-casing means in a substantially tandem manner.

28. A device in accordance with claim 11, further comprising:

a pre-compression station pre-pressing the material in said pressing box before said compressing of the material by said stationary press means.

29. A device in accordance with claim 28, further comprising:

a plurality of said pre-compression stations delivering a plurality of said press boxes to said stationary press means for said compressor.

* * * * *

UNITED STATES PATENT AND TRADEMARK OFFICE

CERTIFICATE OF CORRECTION

PATENT NO. : 5,125,210

DATED : June 30, 1992

INVENTOR(S) : Jurgen Lang, et al

It is certified that error appears in the above-identified patent and that said Letters Patent is hereby corrected as shown below:

On the title page: Item [54] and Column 1, line 1

Please change the title of the invention from:

PROCEDURE AND DEVICE FOR THE WRAPPING OS COMPRESSED BALES to:

PROCEDURE AND DEVICE FOR THE WRAPPING OF COMPRESSED BALES

Signed and Sealed this

Fourteenth Day of September, 1993

Bruce Lehman

*Attest:*

BRUCE LEHMAN

*Attesting Officer*

*Commissioner of Patents and Trademarks*